US006478634B2

(12) United States Patent
Fukuda

(10) Patent No.: US 6,478,634 B2
(45) Date of Patent: Nov. 12, 2002

(54) BATTERY TERMINAL

(75) Inventor: Eiji Fukuda, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/922,765

(22) Filed: Aug. 7, 2001

(65) Prior Publication Data

US 2002/0019178 A1 Feb. 14, 2002

(30) Foreign Application Priority Data

Aug. 7, 2000 (JP) ..... 2000-237942

(51) Int. Cl.[7] ..... H01R 4/28
(52) U.S. Cl. ..... 439/761; 439/769
(58) Field of Search ..... 439/761, 754, 439/759, 769, 772, 773, 774

(56) References Cited

U.S. PATENT DOCUMENTS 1,977,179 A * 10/1934 Fisch ..... 439/761
2,445,946 A * 7/1948 Harper ..... 439/759
2,602,105 A * 7/1952 Welch ..... 439/759
2,878,460 A * 3/1959 Coleman ..... 439/757
3,064,231 A * 11/1962 Satrum ..... 439/759
5,389,466 A * 2/1995 Inoue et al. ..... 428/178
5,595,510 A * 1/1997 Obligar ..... 439/761

FOREIGN PATENT DOCUMENTS

JP 6-60053 8/1994 ..... H01M/2/20

* cited by examiner

*Primary Examiner*—Tulsidas Patel
(74) *Attorney, Agent, or Firm*—Sughrue Mion, PLLC

(57) ABSTRACT

A terminal body is made of a conductive, resilient strip extending while forming an annular fitting portion having a first diameter which is smaller than a diameter of a battery post. An operating member is fitted with both end portions of the strip so as to movable between a first position in which the strip is retained such that the annular fitting portion has a second diameter which is larger than the diameter of the battery post, against a restoring force of the resilient strip, and a second position in which the restoring force is released. The battery post is fitted into the annular fitting portion of the terminal body while placing the operating member in the first position. The operating member is placed in the second position, after the terminal body is fitted on the battery post.

8 Claims, 9 Drawing Sheets

BATTERY TERMINAL

BACKGROUND OF THE INVENTION

This invention relates to a battery terminal connected to an electrode (battery post) of a battery mounted on an automobile or the like, and more particularly to a battery terminal which can be mounted on the battery post with a small force in a one-touch manner without the use of a fastening tool such as an impact wrench.

One known battery terminal, which can be mounted on a battery post with one touch, is disclosed in Japanese Utility Model Publication No. 6-60053U.

FIG. 8 shows the construction of the battery terminal disclosed in the above publication. In this battery terminal 30, a cam lever (operating lever) 32 is pivotally mounted on a terminal body 31. The terminal body 31 includes a post fitting portion 33, bent and curved into a generally C-shape or annular shape, and a pair of parallel extended portions 34 and 35 extending respectively from both ends of the C-shaped post fitting portion 33. A pivot shaft 36 is mounted on the pair of extended portions 34 and 35, and the cam lever 32 is pivotally supported on this pivot shaft 36. An electric wire W is connected to one extended portion 34.

The operation will be described with reference to FIGS. 9A and 9B. When the cam lever 32 is in an upstanding condition as shown in FIG. 9A, a cam portion 32*a* of this cam lever 32 does not interfere with the battery post 40 so that the bore of the post fitting portion 33 of the battery terminal 30 is increased. Therefore, in this condition, the post fitting portion 33 can be easily fitted on a battery post 40.

After the post fitting portion 33 is loosely fitted on the battery post 40, the cam lever 32 is brought down as shown in FIG. 9B, so that the cam portion 32*a* is pressed against a peripheral face of the battery post 40. As a result, the post fitting portion 33 of the battery terminal 30 is secured to the peripheral face of the battery post 40 under pressure by a reaction force produced by the pressing of the cam portion 32*a*. As a result, the battery terminal 30 is electrically and mechanically connected to the battery post 40 by a friction force between the inner peripheral face of the post fitting portion 33 and the outer peripheral face of the battery post 40.

In the above related battery terminal 30, the force of press-fitting of the post fitting portion 33 to the battery post 40 is obtained by pivotally moving the cam lever 32, and therefore the large operating force is required.

SUMMARY OF THE INVENTION

With the above problem in view, it is an object of this invention to provide a battery terminal in which a required press-fitting force can be obtained with a small operating force.

In order to achieve the above object, according to the present invention, there is provided a battery terminal connected to a battery post, comprising:

a terminal body, made of a conductive, resilient strip extending while forming an annular fitting portion having a first diameter which is smaller than a diameter of the battery post; and an operating member, fitted with both end portions of the strip so as to movable between a first position in which the strip is retained such that the annular fitting portion has a second diameter which is larger than the diameter of the battery post, against a restoring force of the resilient strip, and a second position in which the restoring force is released.

According to the present invention, there is also provided a method of connecting a battery terminal and a battery post, comprising the steps of:

providing a terminal body, made of a conductive, resilient strip extending while forming an annular fitting portion having a first diameter which is smaller than a diameter of the battery post;

fitting an operating member with both end portions of the strip so as to movable between a first position in which the strip is retained such that the annular fitting portion has a second diameter which is larger than the diameter of the battery post, against a restoring force of the resilient strip, and a second position in which the restoring force is released;

fitting the battery post into the annular fitting portion of the terminal body while placing the operating member in the first position; and placing the operating member in the second position, after the terminal body is fitted on the battery post.

In the above configurations, since the diameter of the annular fitting portion can be restored into the first diameter by its own resilient force, the operating force, required for effecting the press-fitting, is merely the force for moving the operating member from the first position to the second position. Therefore, the battery terminal can be fitted on the battery post with the relatively small force as compared with the related construction.

Preferably, the both end portions of the resilient strip extend outwards while intersecting with each other. The operating member grips the both end portions of the resilient strip inwards at the first position thereof.

In this configuration, the area of press-fitting of the fitting portion to the battery post can be increased as much as possible. Further, the operation for increasing the diameter of the annular fitting portion is easy, and for decreasing the diameter in this condition, it is only necessary to cancel the gripping, and therefore the operation for press-fitting the fitting portion to the battery post can be effected easily.

Here, it is preferable that the operating member is provided as a frame member having a wide portion and a narrow portion. The both end portions of the resilient strip is placed within the narrow portion of the frame member when the operating member is in the first position, and is placed within the wide portion of the frame member when the operating member is in the second position.

In this configuration, by receiving the both end portions of the terminal body in the narrow portion of the frame member, the diameter of the annular fitting portion of the terminal body can be increased so as to be loosely fitted on the battery post. Merely by moving the frame member such that the both end portions are placed into the wide portion, the diameter of the annular fitting portion can be decreased by its own resilient force.

Here, it is preferable that the wide portion and the narrow portion are continuously connected. In this configuration, since the both end portions of the terminal body are smoothly moved from the narrow portion to the wide portion, merely by moving the operating member, the battery terminal can be easily press-fitted to the battery post.

BRIEF DESCRIPTION OF THE DRAWINGS

The above objects and advantages of the present invention will become more apparent by describing in detail preferred exemplary embodiments thereof with reference to the accompanying drawings, wherein like reference numerals designate like or corresponding parts throughout the several views, and wherein.

DETAILED DESCRIPTION OF THE PREFERRED EMBODIMENTS

A preferred embodiment of the present invention will now be described with reference to the drawings.

Figure 1:
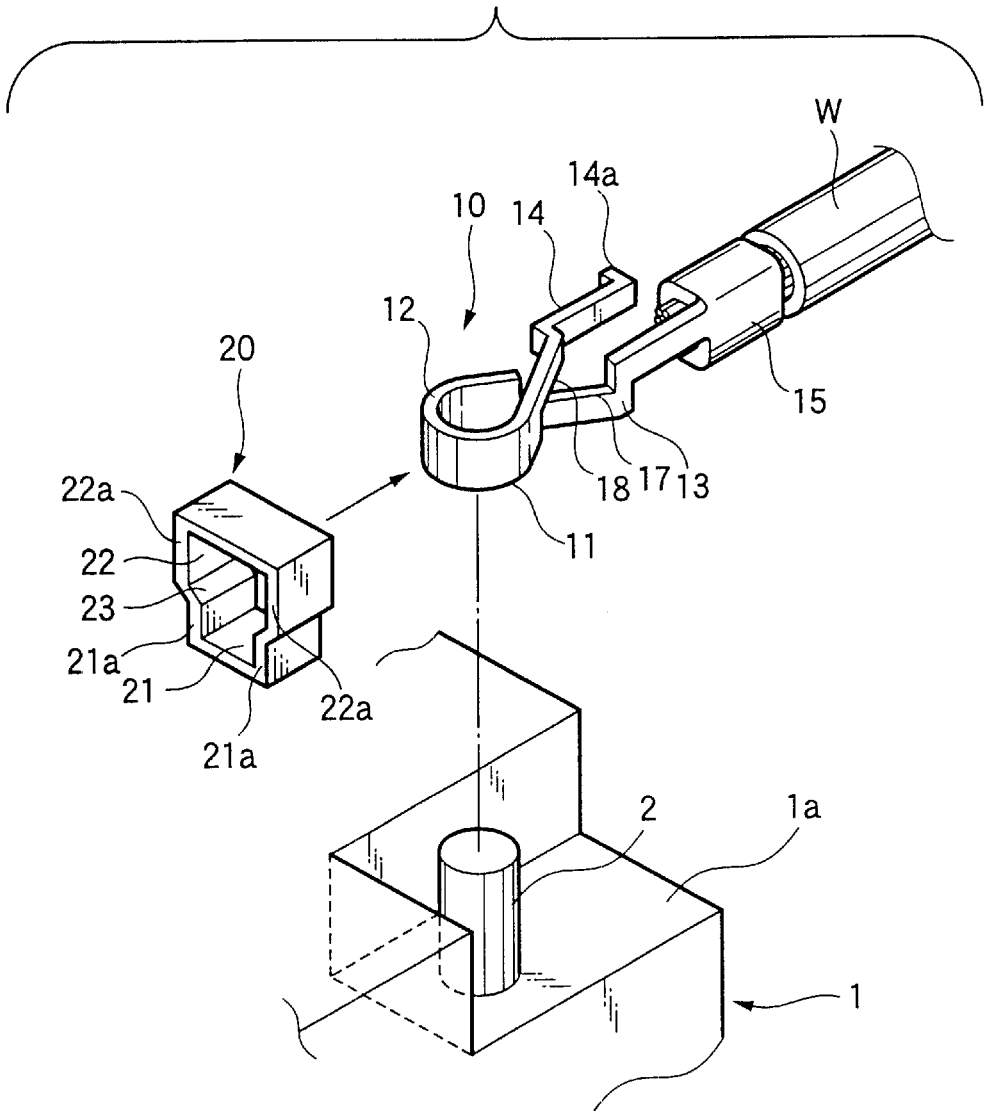
FIG. 1 is an exploded, perspective view of a battery terminal according to one embodiment of the present invention.
Figure 2:
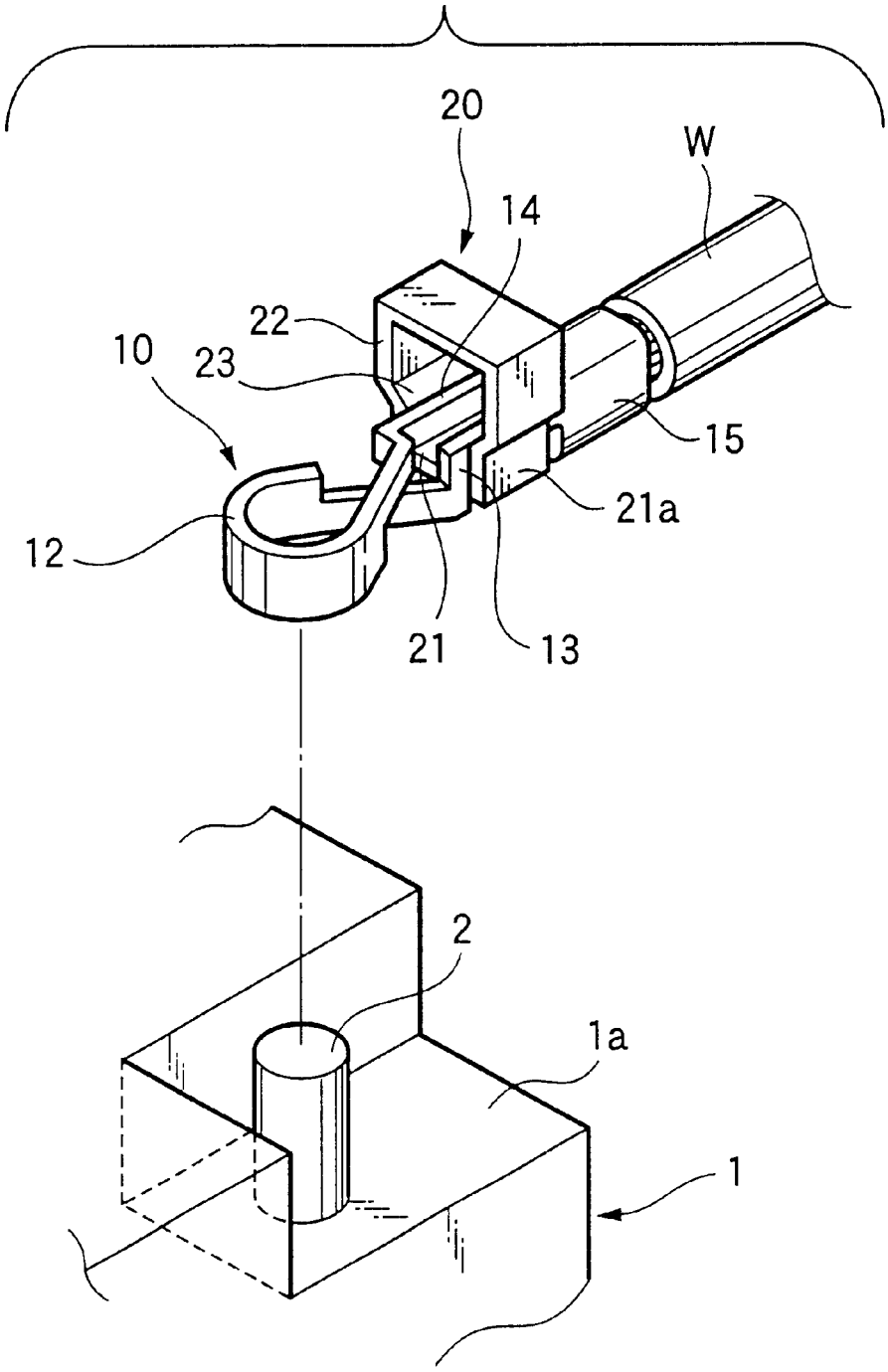
FIG. 2 is a perspective view showing a condition before the battery terminal is mounted on a battery post.

As shown FIG. 1, a battery post 2 is formed on and projects upwardly from a bottom face of a recessed portion 1*a* formed at a corner portion of a battery 1. The battery terminal to be connected to this battery post 2 comprises a terminal body 10, and a retaining frame 20 attached to this terminal body 10. The terminal body 10 is made of metal. The retaining frame 20 may be made of metal, or molded resin.

The terminal body 10 is formed by bending and curving a metal strip. 11, and this terminal body includes an annular post fitting portion 12, which has an inner diameter smaller than an outer diameter of the battery post 2, and is adapted to be press-fitted to an outer peripheral face of the battery post 2 by its own resilient force, and a pair of operating pieces 13 and 14 formed respectively by extending both ends of the strip 11 outwardly from the post fitting portion 12. The pair of operating pieces 13 and 14 are formed by extending both ends of the strip 11 outwardly from the post fitting portion 12 in intersecting relation to each other. Notches 17 and 18 are formed respectively in those portions of the two operating pieces 13 and 14, intersecting each other, so that the two operating pieces 13 and 14 can intersect each other without interference. With this arrangement, distal end portions of the two operating pieces 13 and 14 are disposed in parallel, opposed relation to each other at the same level.

A damper 15 is formed with the operating piece 13 for clamping an electric wire W. The other operating piece 14 is cantilevered, and a hook 14*a* is formed at a distal end thereof. This hook 14*a* prevents the disengagement of the retaining frame 20.

Figure 7A:
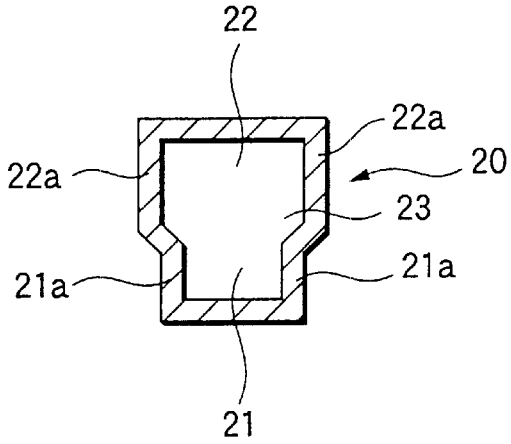
FIGS. 7A to 7C are a cross-sectional view showing the relation between the terminal body and the retaining frame of the battery terminal of the above embodiment, FIG. 7A being the view showing only the retaining frame, FIG. 7B being the view showing a condition in which operating pieces of the terminal body are received in a narrow space of the retaining frame, and FIG. 7C being the view showing a condition in which the operating pieces of the terminal body are received in a wide space of the retaining frame.
Figure 7B:
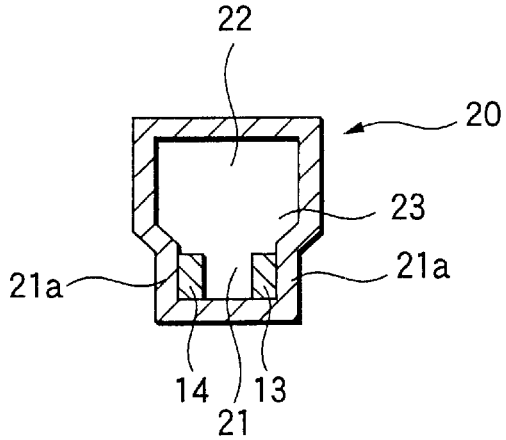

In the retaining frame 20, there are provided a lower narrow space 21, an upper wide space 22 and a shifting space 23 interconnecting these upper and lower spaces, as shown in FIG. 7A. The narrow space 21 has a smaller dimension between opposed side walls 21*a,* and the wide space 22 has a larger dimension between opposed side walls 22*a,* and the shifting space 23 has inclined opposed side walls each interconnecting the corresponding side walls 21*a* and 22*a* of the narrow and wide spaces 21 and 22.

Figure 6A:
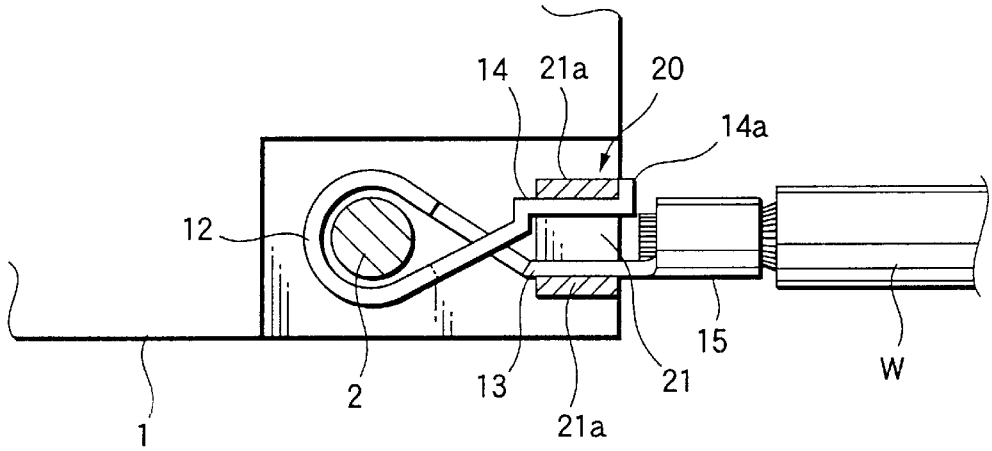
FIGS. 6A and 6B are a plan view showing the relation between the battery terminal of the above embodiment and the battery post, FIG. 6A being the view showing a condition in which the post fitting portion is loosely fitted on the battery post, and FIG. 6B being the view showing a condition in which the post fitting portion is press-fitted to the battery post by pushing and moving the retaining frame from the loosely-fitted condition.

As shown in FIG. 6A, when the two operating pieces 13 and 14 are received in the narrow space 21, the operating pieces 13 and 14 are gripped by the opposed side walls 21*a* from the outside with a pressing force, thereby increasing the post fitting portion 12 into such a diameter that it can be loosely fitted on the outer periphery of the battery post 2.

Figure 6B:
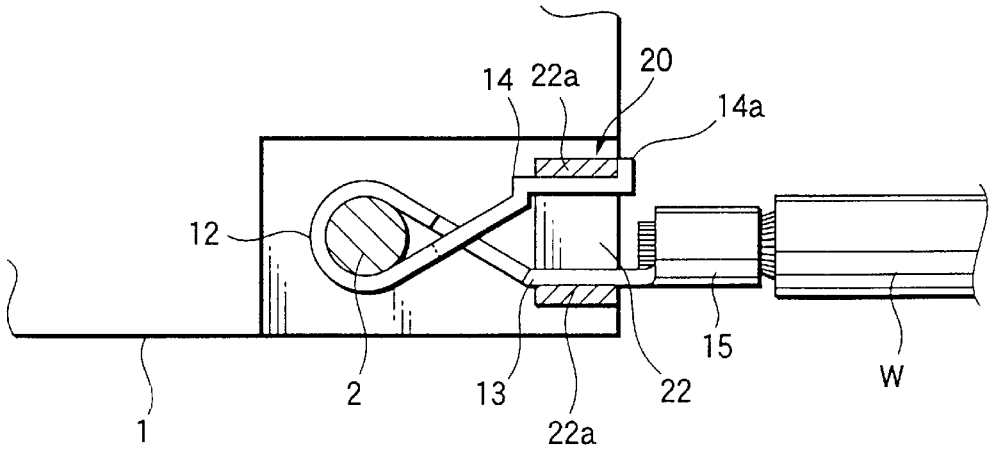

As shown in FIG. 6B, when the two operating pieces 13 and 14 are received in the wide space 22, the above pressing force is released, so that the post fitting portion 12 is press-fitted to the outer peripheral face of the battery post 2 by its own resilient force.

The width of the wide space 22 is so determined that even when the operating pieces 13 and 14 are received in the wide space 22, a slight pressing force acts on the operating pieces 13 and 14. With this arrangement, the rattling of the retaining frame 20 is prevented, and also the hook 14*a* can positively prevent the disengagement of the retaining frame.

Figure 5A:
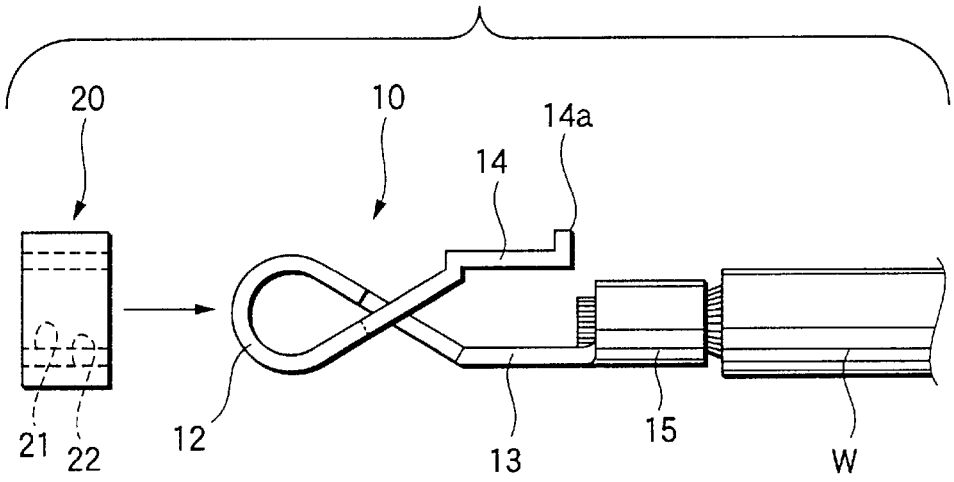
FIGS. 5A and 5B are a plan view showing the relation between a terminal body and a retaining frame of the battery terminal of the above embodiment, FIG. 5A being the view showing a free condition before the retaining frame is attached to the terminal body, and FIG. 5B being the view showing a condition in which the retaining frame is attached to the terminal body to increase the diameter of a post fitting portion.
Figure 5B:
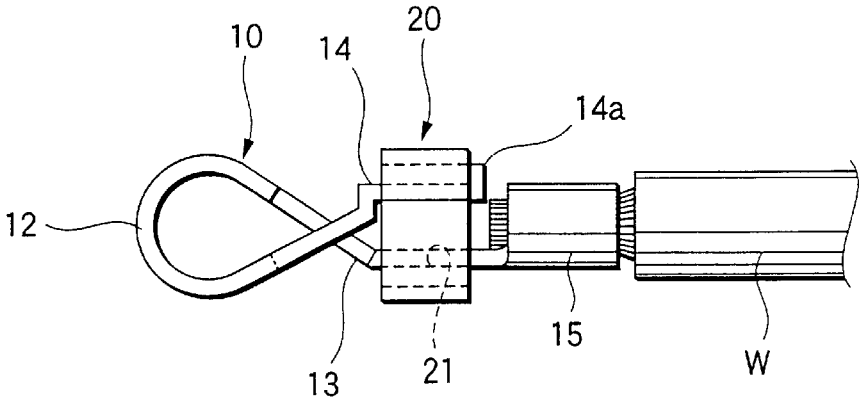

When this battery terminal is to be used, first, the retaining frame 20 is attached to the terminal body 10 through its head portion (i.e., that side where the post fitting portion 12 is provided) after (or before) the electric wire W is clamped by the camper 15 of the terminal body 10, as shown in FIGS. 1 and 5A. Then, the operating pieces 13 and 14 of the terminal body 10, while gripped from the outside, is received in the narrow space 21 in the retaining frame 20, and is provisionally held therein.

When the two operating pieces 13 and 14 of the terminal body 10 are thus received in the narrow space 21 in the retaining frame 20, the operating pieces 13 and 14 are gripped by the opposed side walls 21*a* of the narrow space 21 with the pressing force, so that the post fitting portion 12 is increased in diameter so as to loosely fit on the battery post 2. In this condition, the battery terminal is transferred to a battery connecting stage.

Figure 3:
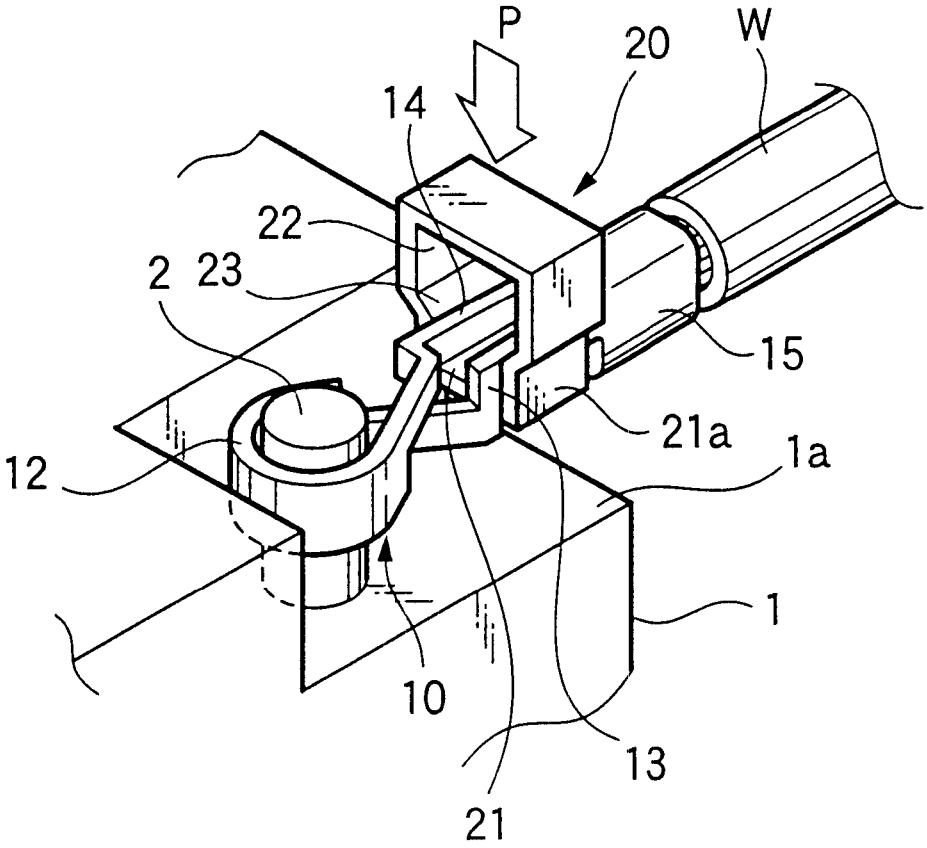
FIG. 3 is a perspective view showing an initial stage of the fitting of the battery terminal on the battery post.
Figure 4:
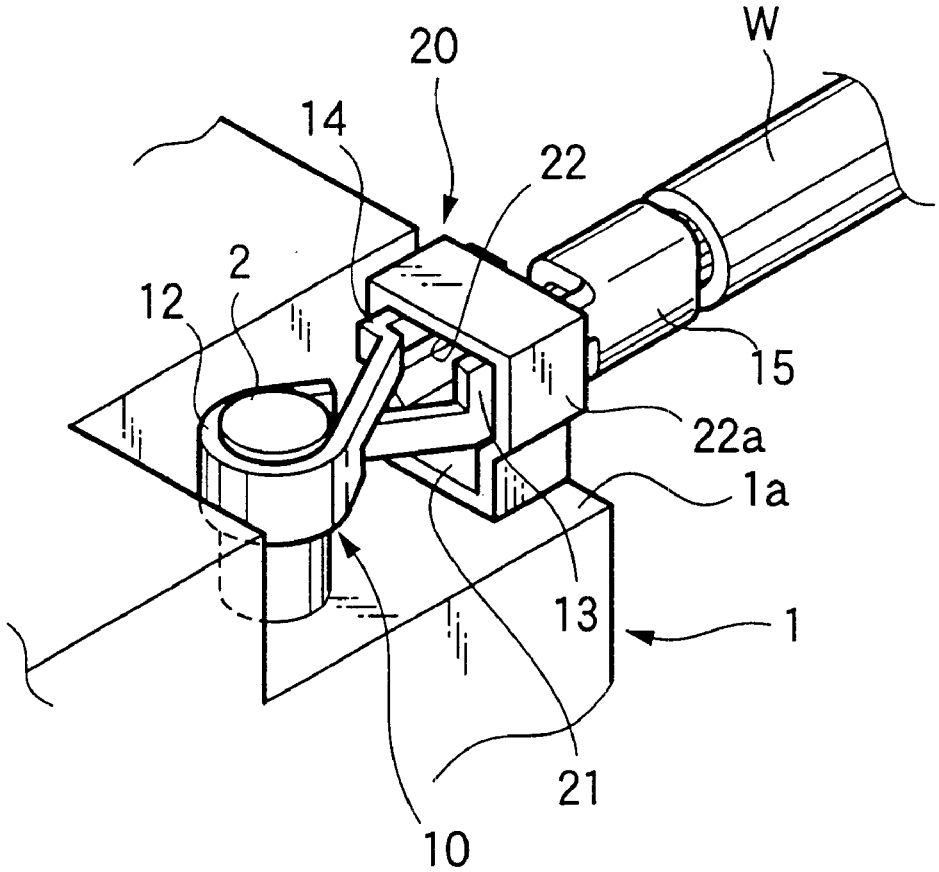
FIG. 4 is a perspective view showing a condition in which the battery terminal is press-fitted to the battery post.
Figure 7C:
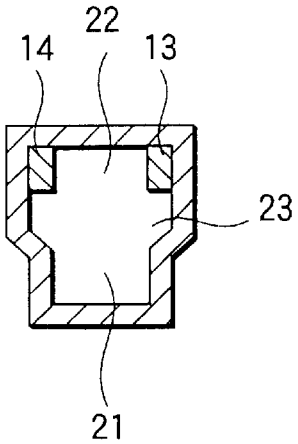
Figure 8:
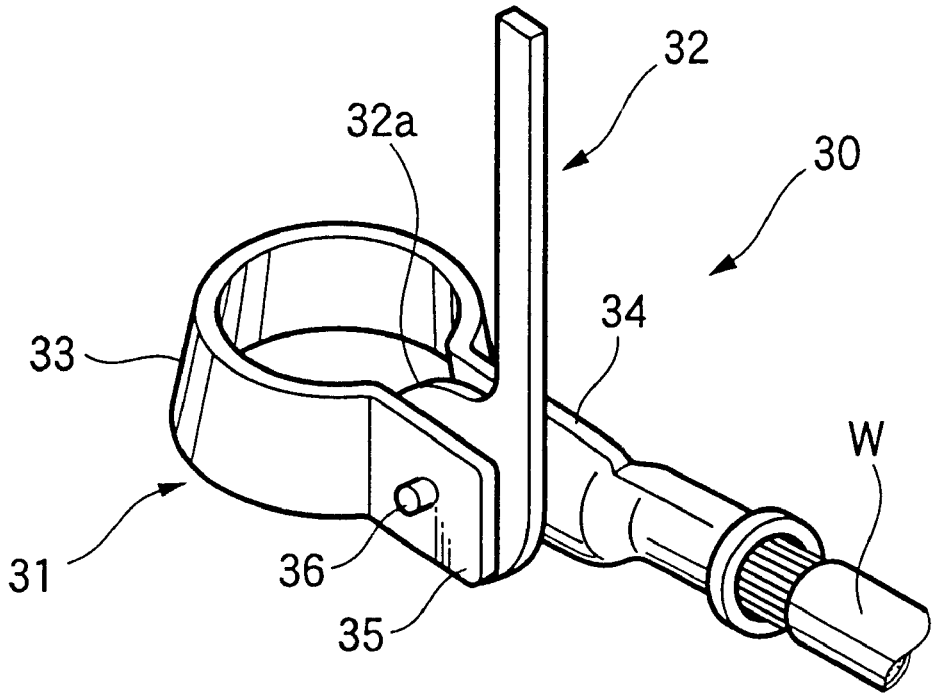
FIG.8 PRIOR ART
FIG. 8 is a perspective view showing a related battery terminal.
Figure 9A:
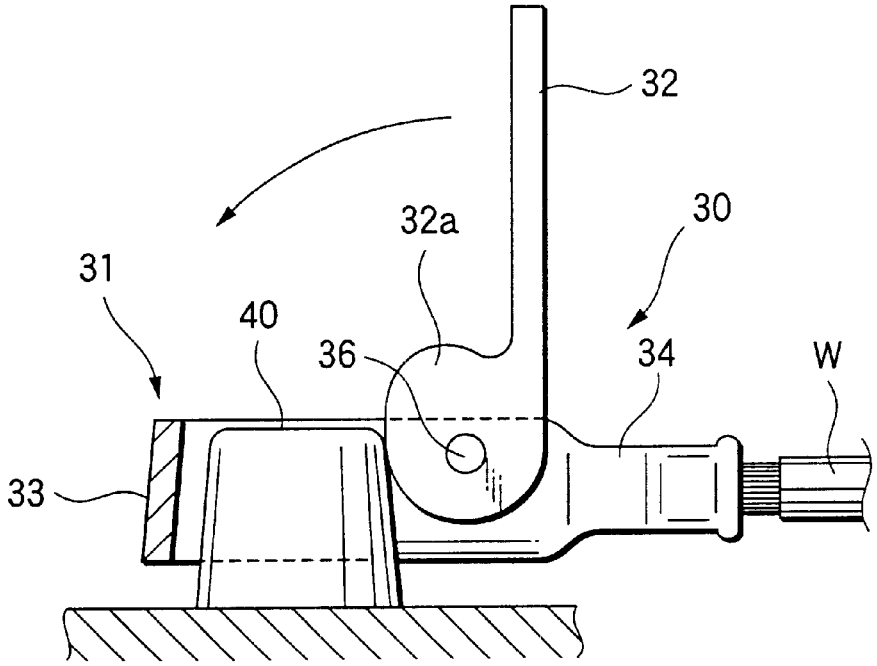
FIG.9A PRIOR ART
FIG. 9A is a side-elevational, cross-sectional view showing a condition in which the battery terminal of FIG. 8 is merely set on a battery post.
Figure 9B:
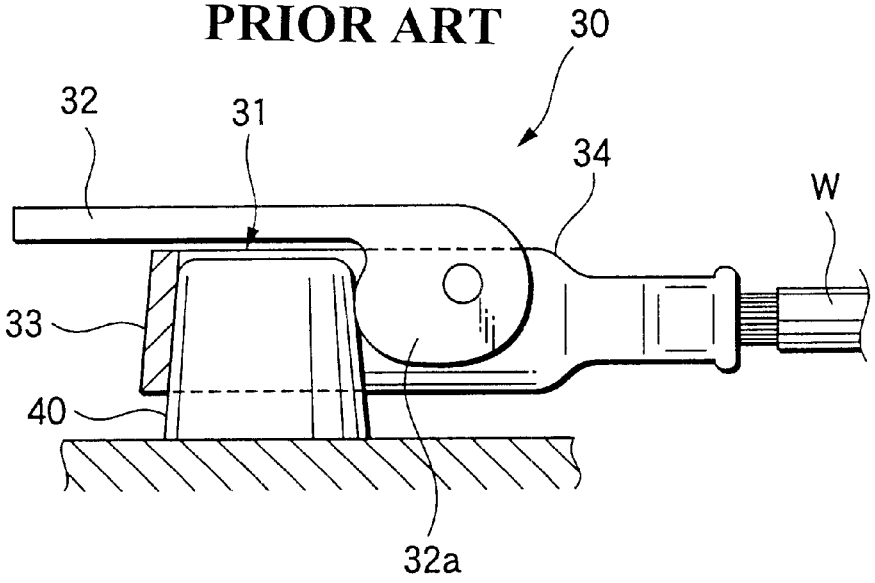
FIG.9B PRIOR ART
FIG. 9B is a side-elevational, cross-sectional view showing a condition in which the battery terminal of FIG. 8 is press-fitted to the battery post by bringing down a lever.

In this battery-connecting stage, the diameter-increased post fitting portion 12 is loosely fitted on the battery post 2 as shown in FIGS. 3 and 6A, and in this condition the retaining frame 20 is pressed down as indicated by arrow P. As a result, the gripping of the operating pieces 13 and 14 in the narrow space 21 is canceled with a small pressing-down force, and as shown in FIGS. 4, 6B and 7C, the operating pieces 13 and 14 move toward the wide space 22, so that the pressing force, acting on the operating pieces 13 and 14 is released. When the pressing force, with which the operating pieces 13 and 14 have so far been gripped, is thus released, the post fitting portion 12 is decreased in diameter by its own resilient force, so that the inner peripheral face of this post fitting portion is press-fitted to the outer peripheral face of the battery post 2, thereby electrically connecting the battery terminal to the battery post 2.

Here, since the operating pieces 13 and 14 extend outwardly from the post fitting portion 12 in intersecting relation to each other, the contacting area between the post fitting portion 12 and the battery post 2 is increased as much as possible. Therefore the stable electrical connection performance is ensured.

Thus, the press-fitting force of the post fitting portion 12 to the battery post 2 is derived only from the resilient force of the terminal body 10, and the operating force, required for connecting the battery terminal, is only the force of pressing down the retaining frame 20. Therefore the mounting operation of the battery terminal can be carried out with the smaller force as compared with the related construction.

And besides, the narrow space 21 and the wide space 22 in the retaining frame 20 are formed as the continuous space, and therefore merely by pressing down the retaining frame 20, the operating pieces 13 and 14 can be easily moved from the narrow space 21 to the wide space 22, and the battery terminal can be easily press-fitted to the battery post 2.

When removing the battery terminal from the battery post 2, the diameter of the post fitting portion 12 can be easily increased by gripping the operating pieces 13 and 14 (for example, those portions thereof exposed from the retaining frame 20) by a tool such as pliers, and therefore the battery terminal can be easily removed from the battery post 2.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

What is claimed is:

1. A battery terminal connected to a battery post, comprising:

a terminal body, made of a conductive, resilient strip extending while forming an annular fitting portion having a first diameter which is smaller than a diameter of the battery post; and an operating member, fitted with both end portions of the strip so as to be movable between a first position in which the strip is retained such that the annular fitting portion has a second diameter which is larger than the diameter of the battery post, against a restoring force of the resilient strip, and a second position in which the restoring force is released, wherein the operating member is provided as a frame member having a wide portion and a narrow portion; and wherein both end portions of the resilient strip are placed within the narrow portion of the frame member when the operating member is in the first position, and are placed within the wide portion of the frame member when the operating member is in the second position.

2. The battery terminal as set forth in claim 1, wherein the both end portions of the resilient strip extend outwards while intersecting with each other; and wherein the operating member grips the both end portions of the resilient strip inwards at the first position thereof.

3. The battery terminal as set forth in claim 1, wherein the wide portion and the narrow portion are continuously connected.

4. A method of connecting a battery terminal and a battery post, comprising the steps of:

providing a terminal body, made of a conductive, resilient strip extending while forming an annular fitting portion having a first diameter which is smaller than a diameter of the battery post;

fitting an operating member, which is a frame member having a wide portion and a narrow portion, with both end portions of the strip so as to be movable between a first position in which the ends of the strip are retained within said narrow portion such that the annular fitting portion has a second diameter which is larger than the diameter of the battery post, against a restoring force of the resilient strip, and a second position in which the ends of the strip are retained within said wide portion such that the restoring force is released;

fitting the battery post into the annular fitting portion of the terminal body while placing the operating member in the first position; and placing the operating member in the second position, after the terminal body is fitted on the battery post.

5. A battery terminal, comprising:

a terminal body including a conductive, resilient strip which defines an annular portion and includes two end portions which intersect one another; and an operating member, independent of and removable from the terminal body and fittable with the end portion of the strip, said operating member being movable from a first position, in which the end portions are retained such that the annular fitting portion has a first diameter which is smaller than the diameter of a-battery post, to a second position, in which the annular fitting portion has a second diameter which is larger than the diameter of the battery post.

6. A method of connecting a battery terminal to a battery post, comprising the following steps:

providing a terminal body including a conductive, resilient strip which defines an annular portion and includes two end portions which intersect one another;

fitting an operating member to the terminal body, said operating member being independent of and removable from the terminal body and fittable with the end portion of the strip, said operating member being movable from a first position, in which the end portions are retained such that the annular fitting portion has a first diameter which is smaller than the diameter of the battery post, to a second position, in which the annular fitting portion has a second diameter which is larger than the diameter of the battery post;

fitting the battery post into the annular fitting portion of the terminal body with the operating member in the second position; and placing the operating member in the first position, after the terminal body is fitted on the battery post.

7. The battery terminal of claim 5, wherein said operating member is a single-molded member.

8. The method of claim 6, wherein said operating member is a single-molded member.

* * * * *